US011195399B2

(12) United States Patent
Mott et al.

(10) Patent No.: US 11,195,399 B2
(45) Date of Patent: Dec. 7, 2021

(54) HEAT ALARM UNIT

(71) Applicant: Carrier Corporation, Palm Beach Gardens, FL (US)

(72) Inventors: Kenneth J. Mott, Colorado Springs, CO (US); Narval Danvers, Denver, CO (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/644,082

(22) PCT Filed: Sep. 6, 2018

(86) PCT No.: PCT/US2018/049731
§ 371 (c)(1),
(2) Date: Mar. 3, 2020

(87) PCT Pub. No.: WO2019/051074
PCT Pub. Date: Mar. 14, 2019

(65) Prior Publication Data

US 2021/0074136 A1 Mar. 11, 2021

Related U.S. Application Data

(60) Provisional application No. 62/554,863, filed on Sep. 6, 2017.

(51) Int. Cl.
*G08B 17/06* (2006.01)
*G08B 17/113* (2006.01)
*G08B 29/14* (2006.01)

(52) U.S. Cl.
CPC ..... *G08B 17/06* (2013.01); *G08B 17/113* (2013.01); *G08B 29/145* (2013.01)

(58) Field of Classification Search
CPC ..... G08B 17/06; G08B 17/113; G08B 29/145
USPC ..... 340/584
See application file for complete search history.

(56) References Cited

U.S. PATENT DOCUMENTS

| | | | |
|---|---|---|---|
| 3,246,086 | A | 4/1966 | Jacobson |
| 3,715,700 | A | 2/1973 | Gloeckler |
| 5,450,066 | A | 9/1995 | Brighenti et al. |
| 6,288,638 | B1 | 9/2001 | Tanguay et al. |

(Continued)

FOREIGN PATENT DOCUMENTS

| | | | |
|---|---|---|---|
| CN | 102903200 | A | 1/2013 |
| CN | 205158572 | U | 4/2016 |

(Continued)

OTHER PUBLICATIONS

Written Opinion from the International Searching Authority for International Application No. PCT/US2018/049731; International Filing Date: Sep. 6, 2018; dated Dec. 6, 2018; 9 Pages.

(Continued)

*Primary Examiner* — John A Tweel, Jr.
(74) *Attorney, Agent, or Firm* — Cantor Colburn LLP

(57) ABSTRACT

A heat alarm unit includes a housing and a button assembly. The housing has a central axis and defines an opening disposed substantially normal to like housing. The button assembly is exposed through the opening and is constructed and arranged to move with respect to the housing. The button assembly has a support structure and a heat sensor supported by the support structure.

4 Claims, 3 Drawing Sheets

(56) References Cited

U.S. PATENT DOCUMENTS

| | | | | |
|---|---|---|---|---|
| 7,011,444 | B2 | 3/2006 | Mayusumi et al. | |
| 7,802,918 | B2 | 9/2010 | Dohi et al. | |
| 8,106,784 | B2 | 1/2012 | Katou et al. | |
| D716,170 | S | 10/2014 | Hojmose | |
| 9,157,808 | B2 | 10/2015 | Braam et al. | |
| 9,217,675 | B2 | 12/2015 | Yang et al. | |
| 9,704,365 | B2 | 7/2017 | Brigham et al. | |
| 10,096,222 | B2 * | 10/2018 | Brigham | G01J 5/20 |
| 2003/0058116 | A1 * | 3/2003 | Mayusumi | G08B 17/06 340/584 |
| 2016/0217682 | A1 | 7/2016 | Brigham et al. | |

FOREIGN PATENT DOCUMENTS

| | | | |
|---|---|---|---|
| CN | 205948248 | U | 2/2017 |
| EP | 1298615 | A2 | 4/2003 |
| EP | 2402920 | A2 | 1/2012 |
| EP | 2500639 | A2 | 9/2012 |
| EP | 2685437 | B1 | 2/2016 |
| GB | 1132733 | A | 11/1968 |
| JP | 3849721 | B2 | 11/2006 |
| JP | 2011192244 | A | 9/2011 |
| KR | 200440867 | Y1 | 7/2008 |
| WO | 2015033107 | A1 | 3/2015 |

OTHER PUBLICATIONS

International Search Report for International Application No. PCT/US2018/049731; Date of Completion: Nov. 28, 2018; dated Dec. 6, 2018; 5 Pages.

* cited by examiner

HEAT ALARM UNIT

CROSS-REFERENCE TO RELATED APPLICATIONS

This Application is a Non-Provisional Application of PCT/US2018/049731, filed Sep. 6, 2018, which claims the benefit of Ser. No. 62/554,863, filed Sep. 6, 2017, the disclosure of which is incorporated herein by reference in its entirety.

BACKGROUND

The present disclosure relates to an alarm unit, and more particularly, to a heat alarm unit with a centrally located heat sensor.

Heat alarm units, such as those used in residential homes, function to alert an occupant of an unusual elevation in ambient air temperature, that may signify a fire condition. The heat alarm unit may include a housing, a plurality of heat sensors, a button for testing of the unit, a visual and/or audible notifier (e.g., light), a visual and/or audible alarm, control circuitry, and a power source that may be a battery. The control circuitry is contained within the housing. The housing may include an opening through which the button is exposed. The plurality of heat sensors may be mounted within the housing and generally scattered circumferentially about the housing. The housing may include other openings to reveal the visual notifier (e.g., LED/light) and/or transmit sound from the audible alarm.

Further enhancements in packaging of the heat alarm unit is desirable for cosmetic improvements, reduction in cost, and/or optimization of sensor responsiveness.

BRIEF DESCRIPTION

A heat alarm unit according to one, non-limiting, embodiment of the present disclosure includes a housing including a central axis and defining an opening disposed substantially normal to the housing; and a button assembly exposed through the opening and constructed and arranged to move with respect to the housing, the button assembly including a support structure and a heat sensor supported by the support structure.

Additionally to the foregoing embodiment, the opening and the button assembly are substantially concentric to the central axis.

In the alternative or additionally thereto, in the foregoing embodiment, the housing defines a chamber and the opening is in direct fluid communication with the chamber.

In the alternative or additionally thereto, in the foregoing embodiment, the heat alarm unit includes control circuitry disposed in the chamber and operatively connected to the support structure and electrically connected to the heat sensor.

In the alternative or additionally thereto, in the foregoing embodiment, the heat sensor is a thermistor.

In the alternative or additionally thereto, in the foregoing embodiment, the heat sensor consists of one heat sensor.

In the alternative or additionally thereto, in the foregoing embodiment, the button assembly is resiliently biased outward through the opening.

In the alternative or additionally thereto, in the foregoing embodiment, the housing includes a base constructed and arranged to be attached to a surface, and a cover detachably connected to the base with the opening in the cover.

In the alternative or additionally thereto, in the foregoing embodiment, the heat alarm unit includes an electric test switch in operable contact with a shuttle of the support structure, wherein the support structure further includes a centerline, a touch pad centrally located with respect to the centerline and exposed through the housing, and a plurality of axially extending pedestals extending between and attached to the shuttle and the touch pad.

In the alternative or additionally thereto, in the foregoing embodiment, the heat sensor is disposed at least in-part between the shuttle and the touch pad.

In the alternative or additionally thereto, in the foregoing embodiment, the heat sensor is spaced radially inward from the plurality of pedestals.

In the alternative or additionally thereto, in the foregoing embodiment, the heat sensor is centered to the centerline.

In the alternative or additionally thereto, in the foregoing embodiment, the centerline co-extends with the center axis.

In the alternative or additionally thereto, in the foregoing embodiment, the heat sensor includes an electrical lead and a sensor element and the sensor element is spaced axially between the shuttle and the touch pad.

In the alternative or additionally thereto, in the foregoing embodiment, the heat sensor includes an electrical lead and a sensor element, and the sensor element is not in the chamber.

A heat alarm unit according to another, non-limiting, embodiment includes a housing defining a chamber and an opening in fluid communication with the opening, wherein the opening is centered to a central axis; a shuttle outwardly and axially biased and extending through the opening; a touch pad axially spaced from and engaged to the shuttle, wherein the touch pad is visually exposed through the housing for pressing by user to perform a heat alarm test; a heat sensor element disposed axially between the touch pad and the shuttle, wherein the heat sensor element is centered to the central axis; and an electrical heat sensor lead electrically connected to the heat sensor element and attached to the shuttle, wherein the electrical heat sensor lead provides the structural positioning of the heat sensor element.

Additionally to the foregoing embodiment, the heat alarm unit includes control circuitry disposed in the chamber; and an electrical test switch in operable contact with the shuttle and electrically connected to the control circuitry.

In the alternative or additionally thereto, in the foregoing embodiment, the heat alarm unit includes a plurality of pedestals each extending axially between, and attached to, the shuttle and the touch pad.

In the alternative or additionally thereto, in the foregoing embodiment, the plurality of pedestals are circumferentially spaced from one-another, and radially spaced outward from the heat sensor element.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

In some applications, a plurality of heat alarm units may be wired in series, or otherwise communicate with one-another, such that when one heat alarm unit is triggered all of the heat alarm units may initiate an alarm/alert.

Figure 1:
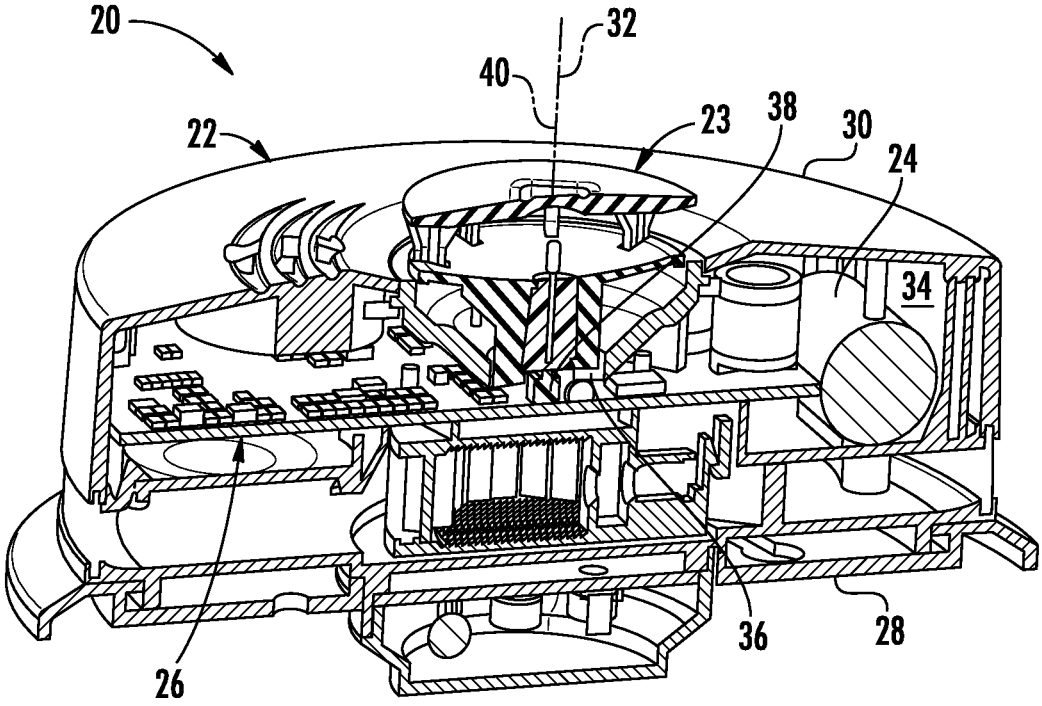
FIG. 1 is a perspective cross section of a heat alarm unit as one, non-limiting, exemplary embodiment of the present disclosure.

Referring to FIG. 1, a heat alarm unit 20 is constructed and arranged to be secured to a surface (not shown) that may be a ceiling, a wall, or another surface of a room in, for example, a residential home. The heat alarm unit 20 may include a housing 22, a test button assembly 23, a power source 24, and control circuitry 26. The housing 22 may include a base 28 and a cover 30 that secures to the base 28. The base 28 may be substantially planar, may be in contact with and is attachable to the surface, and is substantially normal to a central axis 32 of the heat alarm unit 20. The control circuitry 26 is disposed in a chamber 34 including boundaries defined by the base 28 and the cover 30. An opening 36 may include a peripheral boundary defined by the cover 30, and is in direct fluid communication with the chamber 34.

In operation, the control circuitry 26 of the heat alarm unit 20 may be powered by the power source 24 (e.g., battery, wired power connection, or wireless power connection), and functions to detect an abnormal rate of temperature increase that exceeds a temperature rate increase threshold, and/or a temperature that exceeds a high temperature threshold. The temperature rate increase threshold and the high temperature threshold may be preprogrammed into the control circuitry. The test button assembly 23 may function to test proper operation of the control circuitry 26 and/or verify that the power source is not depleted. Although not illustrated, when a user actuates the test button assembly 23, an audible or visual (e.g., LED) notification may initialize to inform the user of current operational conditions. It is contemplated and understood that the power source 24 may include an Alternating Current (AC) or Direct Current (DC) voltage source that may be hard-wired, and a back-up battery. In embodiments where the heat alarm unit 20 is hard-wired for electrical AC or DC voltage power, multiple units may be wired in series, and may be further configured to communicate with one-another.

In one embodiment, the opening 36 may lie along an imaginary plane that is substantially normal to the central axis. The test button assembly 23 may be axially, and resiliently biased outwardly, through the opening 36. A force applied by the user to the externally exposed test button assembly 23, and that exceeds the biasing force, will cause the assembly 23 to move axially and, in-part, into the chamber 34. When moving axially into the chamber 34, the test button assembly 23 may mechanically actuate a switch 38 of the heat alarm unit 20 located in the chamber 34 and electrically connected to the control circuitry 26.

Figure 2:
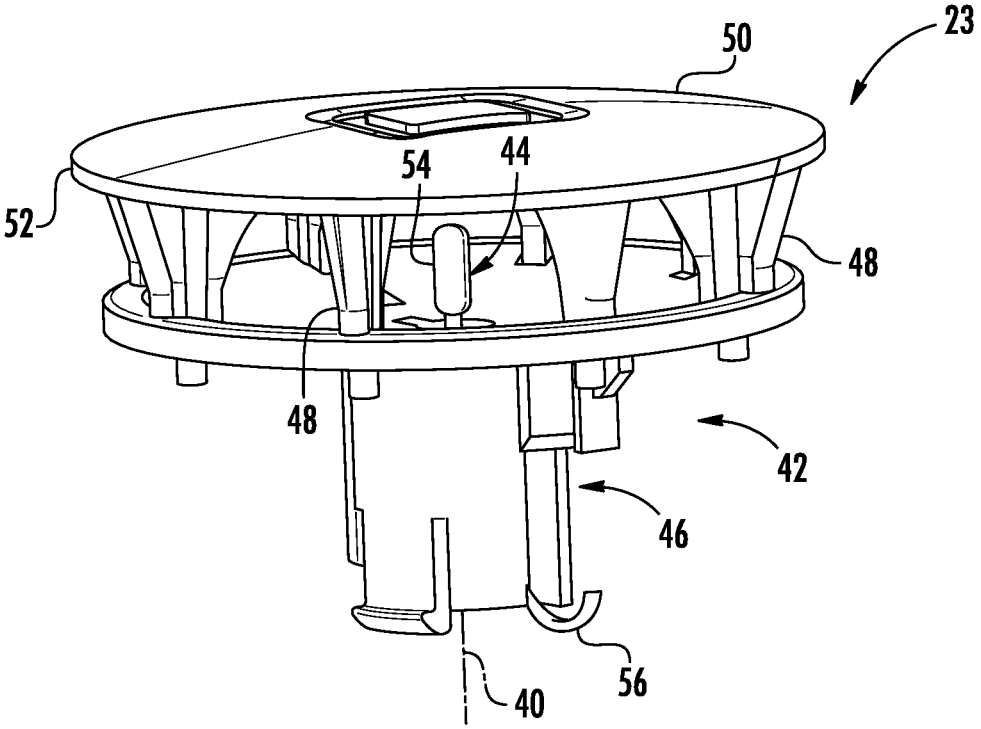
FIG. 2 is a perspective view of a test button assembly of the heat alarm unit.
Figure 3:
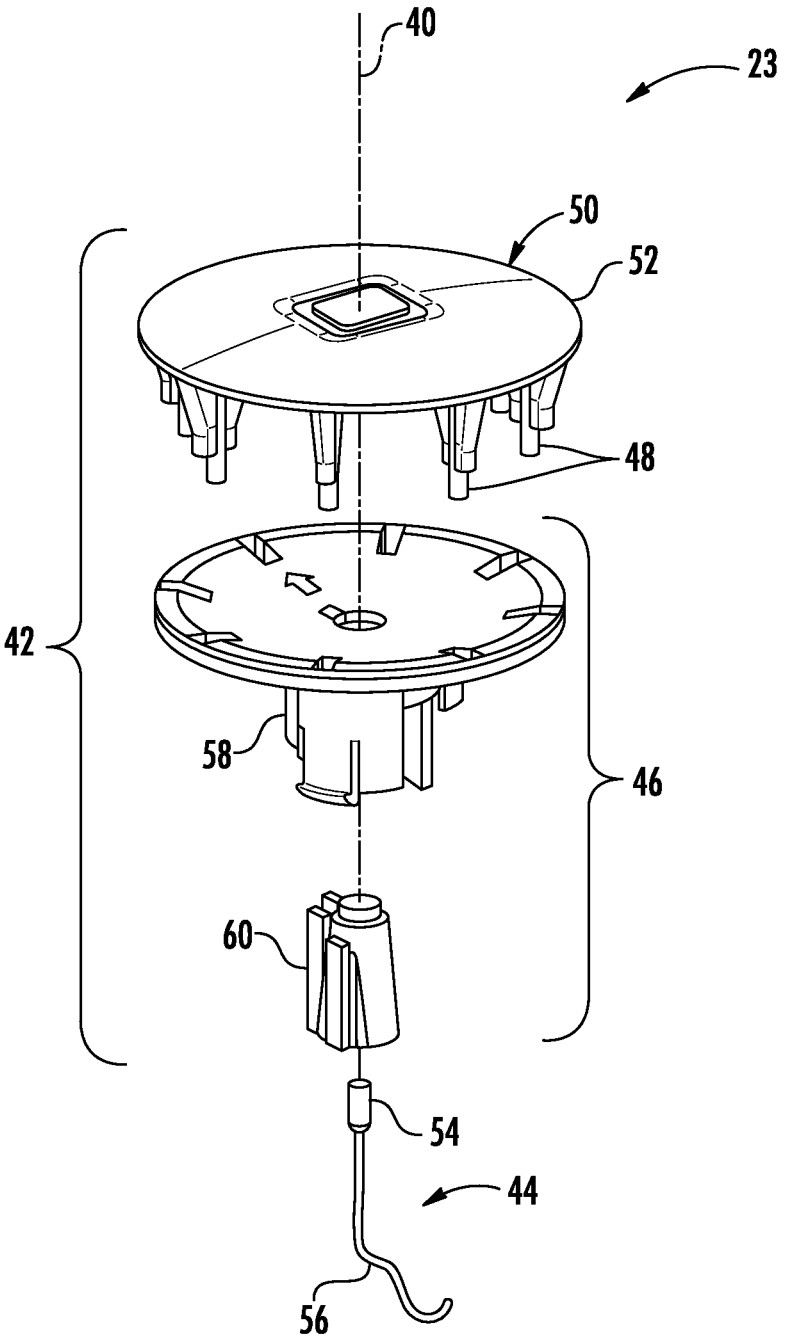
FIG. 3 is an unassembled perspective view of the test button assembly.

Referring to FIGS. 2 and 3, the test button assembly 23 is constructed and arranged to move axially along a centerline 40 between a normal state (see FIG. 1) and a depressed state for testing. The centerline 40 may co-extend with the central axis 32. The test button assembly 23 may include a support structure 42 and a heat sensor 44 attached to and carried by the support structure 42. The support structure 42 is attached to the heat sensor 44 and may extend axially through the opening 36 and into the chamber 34 for operative contact with the switch 38. In one embodiment, the resilient force that biases the support structure 42 axially outward toward the normal state may be produced by a resilient spring (not shown) compressed axially between the housing 22 and the support structure 42, or internal to the switch 38. In another embodiment, the biasing force may be produced by a resiliently flexible member (not shown) attached to and extending between the housing 22 and the support structure 42.

The support structure 42 of the test button assembly 23 may include a shuttle 46, a plurality of pedestals 48, and a touch pad 50. The shuttle 46 carries the heat sensor 44 and extends axially through the opening 36. The touch pad 50 is exposed externally from the cover 30 of the housing 22 regardless of whether the button assembly 23 is in the normal state or depressed state for testing. The plurality of pedestals 48 may each extend axially, and are attached to, the touch pad 50 and the shuttle 46 at opposite ends. Each pedestal 48 is circumferentially spaced from the next adjacent pedestal, and are proximate to a circumferentially continuous periphery 52 of the touch pad 50. The pedestals 48 may be manufactured as one unitary piece with the touch pad 50, and may snap fit to the shuttle 46. In one embodiment, when the test button assembly 23 is in the normal state, the pedestals 48 are exposed externally from the cover 30, and thus exposed to ambient air in the room.

The heat sensor 44 may include a sensor element 54 and at least one electrical lead 56 (i.e., two illustrated). The sensor element 54 may be substantially centered to the centerline 40, may be axially spaced between the shuttle 46 and the touch pad 50, and is spaced radially inward from the pedestals 48. In this way, the support structure 42 may protect the sensor element 54 from undesirable physical contact, while exposing the element freely to the surrounding ambient air for optimizing heat detection capability. To achieve adequate ventilation and/or exposure of the sensor element 54 to the ambient air, a ratio of a diameter of the touch pad 50 over a common axial length of each one of the pedestals 48 may be about 3:1. Alternatively, the ratio of the touch pad surface area over the 360° opening surface area between the touch pad 50 and the shuttle 46 may be about 7:9. In one embodiment, the sensor element 54 is positioned and spaced outside of the cover 30.

Referring to FIG. 3, the shuttle 46 of the support structure 42 may further include a base portion 58 and a connector portion such as a collet 60 that may snap fit axially into the base portion 58. The base portion 58 may further function as a thermal barrier, or heat shield, between the chamber 34 and the outside environment (i.e., ambient air). In this way, any heat generated by the control circuitry 26, the power source 24, and/or thermal conduction into the base 28 of the housing 22 may not influence the sensor element 54 readings. The electrical leads 56 may be rigidly attached to the collet portion 60, and may provide the structural rigidity to space the sensor element 54 from the base portion 58 of the shuttle 46.

When the heat alarm unit 20 is fully assembled and in the normal state, ambient air is free to flow circumferentially between the pedestals 48, and axially between the base portion 58 of the shuttle 46 and the touch pad 50. The sensor element 54 is centrally positioned such that a heat source from any direction (i.e., 360 degrees) may be equally, and responsively, detected. The central positioning of the heat sensor 44 enables use of a single heat sensor. The spacing of the sensor element 54 from any surrounding structures reduces any undesired impact of the surrounding structure acting as a heat sink, or undesired occurrence of thermal conduction into the sensor element 54 from the surrounding structures. An example of the heat sensor 44 may be a thermocouple that may be a thermistor.

Figure 4:
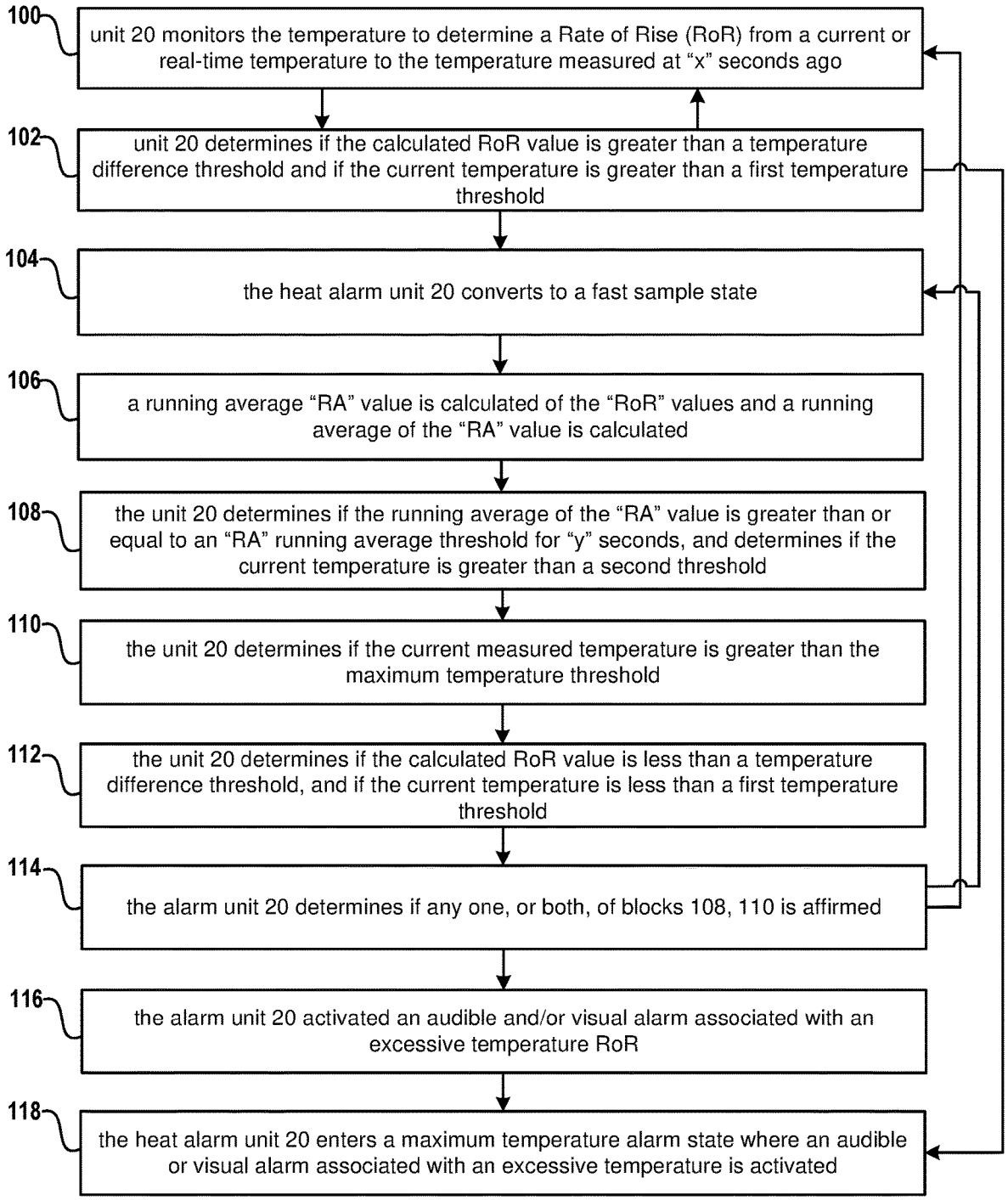
FIG. 4 is a flow diagram of a method of operating the heat alarm unit.

Referring to FIG. 4, a method of operating the heat alarm unit 20 is illustrated. At block 100 the unit 20 monitors the temperature to determine a Rate of Rise (RoR) from a current or real-time temperature to the temperature measured at "x" seconds ago (e.g., 10 seconds ago). That is, the RoR may be calculated to be a temperature difference of current temperature minus a past temperature measured x seconds ago. Simultaneously, at block 100 the unit 20 calculates the current temperature. The method used to calculate the current temperature may differ from that used to calculate the temperature at different points in time for RoR. At block 102 unit 20 determines if the calculated RoR value is greater than a temperature difference threshold and if the current temperature is greater than a first temperature threshold. In one embodiment, the first temperature threshold may be less than the maximum temperature threshold. In some embodiments the first temperature threshold and maximum threshold may be based on regulatory or code requirement, and in other embodiments the first temperature threshold and maximum threshold may be an adjusted amount. For example, the adjusted amount(s) may account for sensor lag, interference, or other physical or electrical characteristics of the sensor 54 or the interaction of the sensor 54 with other components in a sensor package; as an example these adjustments may account for time lag due to the distance of the sensor 54 from the ambient outside the peripheral boundary defined by the cover 30; or for another example, the inherent lag in sensor measurements such as thermistor measurements. Typically such adjustments will lower the value for one or both of the first temperature threshold and maximum threshold. In some embodiments the first temperature threshold may be about ninety-five degrees Fahrenheit (95° F.). If the current temperature is less than the first temperature threshold, or the "Ro" value is less than the temperature difference threshold, the alarm unit 20 returns to block 100 and may continue to detect/measure temperature about, for example, every ten seconds.

If the current temperature is greater than the first temperature threshold but less than the maximum temperature threshold and the "Ro" value is greater than the temperature difference threshold, at block 104 the heat alarm unit 20 converts to a fast sample state. When in the fast sample state, sampling (i.e., temperature measurement) is increased (e.g., rate of rise is sampled once per a fraction of "x", in one example, once per second). At block 106 and while the unit 20 is in the fast sample state, a running average "RA" value is calculated of the "Ro" values and a running average of the "RA" value is calculated. In some embodiments, the calculated amounts of rate of rise, running average of rate of rise, and running average of "RA" may be adjusted to account for sensor lag, interference, or other physical or electrical characteristics of the sensor 54 or the interaction of the sensor 54 with other components in a sensor package such as for example sensor lag as described above. These adjustments for "Ro", "RA", and running average of "RA" may differ from each other and from any adjustments made for the first temperature threshold or maximum threshold. Typically such adjustments will lower the value for one, some, or all of the "Ro", "RA", and running average of "RA". It is understood and contemplated that the order of blocks 104, 106 may be reversed or the execution of both blocks may be performed simultaneously.

At block 108 and while the unit 20 is in the fast sample state, the unit 20 determines if the running average of the "RA" value is greater than or equal to an "RA" running average threshold for "y" seconds (e.g., five seconds), and determines if the current temperature is greater than a second threshold. As above, in some embodiments the thresholds may be based on regulatory or code requirements, and thresholds may be adjusted. In some embodiments the second threshold may be higher than the first temperature threshold, (e.g., around 5-15 degrees Fahrenheit higher. It should be understood that in various embodiments thresholds related to all calculations discussed herein may be based on regulatory or code requirements, and thresholds and other calculations may be adjusted to account for lag, interference, or other physical or electrical characteristics. Once determined, the alarm unit 20 may generally register an "affirm" or "not affirmed" relative to the determinations.

At block 110 the unit 20 determines if the current measured temperature is greater than the maximum temperature threshold (e.g., in one embodiment the maximum temperature threshold 140 degrees Fahrenheit, which may be adjusted within about 5 degrees Fahrenheit of 140 degrees Fahrenheit). Once determined, the alarm unit 20 may generally register an "affirm" or "not affirmed" relative to the determination. At block 112 the unit 20 determines if the calculated RoR value is less than a temperature difference threshold, and if the current temperature is less than a first temperature threshold. Once determined, the alarm unit 20 may generally register an "affirm" or "not affirmed" relative to the determinations. It is understood and contemplated that the order of blocks 108, 110, 112 may be reversed or the execution of one or more of the blocks may be performed simultaneously.

At block 114, the alarm unit 20 determines if any one, or both, of blocks 108, 110 is affirmed. If yes, the alarm unit 20 may advance to an RoR alarm state at block 116. If all of blocks 108, 110, 112 are not affirmed, the alarm unit 20 may remain in the fast sample state and return to block 104. If both blocks 108, 110 are not affirmed but block 112 is affirmed, the alarm unit 20 may exit the fast sample state and return to block 100.

At block 116 and while the alarm unit 20 is in the RoR alarm state, the alarm unit 20 may activate an audible and/or visual alarm associated with an excessive temperature RoR. At block 116 and while the alarm unit 20 is in the RoR alarm state, the alarm unit 20 may, once again, determine if the current measured temperature value is greater than the maximum temperature threshold. If so, at block 118 the heat alarm unit 20 may enter a maximum temperature alarm state where an audible or visual alarm associated with an excessive temperature is activated.

At block 102 and while the alarm unit 20 is in the idle state, the alarm unit 20 may also determine if a current measured temperature exceeds the maximum temperature threshold. If yes, the method proceeds to block 118.

In one or more embodiments, the sensor unit 20 may include a multitude of sensing capabilities. Examples of other capabilities may include smoke detection, CO detection, chemical detection and/or air quality detection, and others. The button assembly 23 may perform a range of tests and other functions. For example, the depression of the button assembly 23 may perform a reset function, may activate or initiate a wireless communication function, and other functions. The sensor unit 20 may be one of a plurality of sensor units each capable of communicating with a central control panel and/or the internet, via wired and/or wireless pathways. It is further contemplated that the sensor units 20 may be configured to communicate with each other.

Advantages and benefits of the present disclosure include a centrally located heat sensor 44 that provides more consistent and responsive measurements. Other advantages include a reduction in product costs and a more robust heat sensor unit.

While the present disclosure is described with reference to illustrated embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A heat alarm unit comprising:

a housing defining a chamber and an opening in fluid communication with the chamber, wherein the opening is centered to a central axis;

a shuttle outwardly and axially biased and extending through the opening;

a touch pad axially spaced from and engaged to the shuttle, wherein the touch pad is visually exposed through the housing for pressing by user to perform a heat alarm test;

a heat sensor element disposed axially between the touch pad and the shuttle, wherein the heat sensor element is centered to the central axis;

an electrical heat sensor lead electrically connected to the heat sensor element and attached to the shuttle, wherein the electrical heat sensor lead provides the structural positioning of the heat sensor element; and a plurality of pedestals each extending axially between, and directly attached to, the shuttle and the touch pad, wherein the plurality of pedestals are circumferentially spaced from one-another, and radially spaced outward from the heat sensor element, and wherein the touch pad, the plurality of pedestals, and the shuttle are adapted to facilitate the free flow of ambient air circumferentially between the plurality of pedestals and axially between the shuttle and the touch pad.

2. The heat alarm unit set forth in claim 1, further comprising: control circuitry disposed in the chamber; and an electrical test switch in operable contact with the shuttle and electrically connected to the control circuitry.

3. The heat alarm unit set forth in claim 1, wherein the sensor element is spaced, and located outside, from the housing.

4. The heat alarm unit set forth in claim 1, wherein a touch pad diameter over an axial pedestal length ratio is about 3:1.

* * * * *